US009137605B2

(12) United States Patent
Manley et al.

(10) Patent No.: US 9,137,605 B2
(45) Date of Patent: Sep. 15, 2015

(54) FORMED DIAPHRAGM FRAME FOR RECEIVER

(71) Applicant: Knowles Electronics LLC, Itasca, IL (US)

(72) Inventors: Matthew Manley, Crystal Lake, IL (US); Alex Grossman, Schaumburg, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 14/301,649

(22) Filed: Jun. 11, 2014

(65) Prior Publication Data

US 2014/0369548 A1 Dec. 18, 2014

Related U.S. Application Data

(60) Provisional application No. 61/835,776, filed on Jun. 17, 2013.

(51) Int. Cl.

| | |
|---|---|
| ***H04R 7/02*** | (2006.01) |
| ***H04R 1/28*** | (2006.01) |
| *H04R 11/04* | (2006.01) |

(52) U.S. Cl.

CPC ..... *H04R 7/02* (2013.01); *H04R 1/2807* (2013.01); *H04R 11/04* (2013.01)

(58) Field of Classification Search

CPC ..... H04R 1/28; H04R 1/08; H04R 9/08; H04R 11/04; H04R 17/02; H04R 21/02; H04R 9/00; H04R 9/025; H04R 9/027; H04R 2307/027; H04R 7/04

USPC ..... 381/345, 351, 171, 396, 418–420, 381/423–424, 427, 431

See application file for complete search history.

(56) References Cited

U.S. PATENT DOCUMENTS

| | | | | |
|---|---|---|---|---|
| 6,078,677 | A * | 6/2000 | Dolleman et al. | 381/418 |
| 6,931,140 | B2 * | 8/2005 | Van Halteren et al. | 381/418 |
| 8,385,583 | B2 * | 2/2013 | Thompson | 381/418 |
| 8,634,587 | B2 * | 1/2014 | Nagumo et al. | 381/398 |
| 2003/0190053 | A1 * | 10/2003 | van Halteren | 381/418 |
| 2007/0230734 | A1 | 10/2007 | Beard | |
| 2008/0063223 | A1 | 3/2008 | Van Halteren et al. | |
| 2009/0296971 | A1 | 12/2009 | Saltykov et al. | |
| 2010/0128905 | A1 | 5/2010 | Warren et al. | |

FOREIGN PATENT DOCUMENTS

| | | | |
|---|---|---|---|
| JP | 2008141694 | A | 6/2008 |

OTHER PUBLICATIONS

International Search Report and Written Opinion for PCT/US2014/042243 dated Oct. 8, 2014 (10 pages).

* cited by examiner

*Primary Examiner* — Suhan Ni

(74) *Attorney, Agent, or Firm* — Fitch, Even, Tabin & Flannery LLP

(57) ABSTRACT

An acoustic apparatus includes a top assembly and a bottom assembly. The bottom assembly is coupled to the top assembly to form an overall assembly. A diaphragm assembly is disposed in the overall assembly so as to separate the overall assembly into a front volume and a back volume. The diaphragm assembly includes a frame and the frame has a first end, a second end, and a middle portion that is disposed between the first end and the second end. The first end and the second end are not in the same plane as the middle portion. The first end is coupled to the bottom assembly and the second end is coupled to the top assembly.

8 Claims, 6 Drawing Sheets

FORMED DIAPHRAGM FRAME FOR RECEIVER

CROSS REFERENCE TO RELATED APPLICATIONS

This patent claims benefit under 35 U.S.C. §119 (e) to U.S. Provisional Application No. 61/835,776 entitled "Formed Diaphragm Frame for Receiver" filed Jun. 17, 2013, the content of which is incorporated herein by reference in its entirety.

TECHNICAL FIELD

This application relates to components in acoustic devices and, more specifically, the configuration and arrangement of components that hold the diaphragm in these devices.

BACKGROUND OF THE INVENTION

Acoustic devices include microphones and receivers to mention two examples. In these devices, different electrical components are disposed together within a housing unit. Microphones receive sound energy and convert the sound energy into an electrical signal while receivers receive an electrical signal and convert the electrical signal into sound energy.

Receivers typically include a receiver motor. The receiver motor typically includes a coil, a yoke (or stack), an armature (or reed), and magnets. An electrical signal applied to the coil and creates a magnetic field within the motor which causes the armature to move. Movement of the armature causes movement of a diaphragm, which creates sound. Together, the magnets, armature, and yoke form a magnetic circuit. The yoke may also serve to hold or support the magnets or other components.

Acoustic devices such as receivers also include a front volume and a back volume. If these two areas are not separated and sealed from each other, then problems with the receiver can develop. For example, when the front volume and the back volume are not properly sealed from each other, then the quality of the sound produced is often inadequate.

The separation and sealing of the different volumes in an acoustic device can be a complicated and costly procedure. More specifically, separate seals are often provided and used to ensure the separation and/or sealing of the front volume from the back volume. Unfortunately, these procedures also introduce complications into the manufacturing process. This increases the cost of the device that is being produced.

Various types of tubes also need to be attached to the acoustic device. For example, sound tubes often need to be attached to the acoustic device. Unfortunately, with present approaches it is sometimes difficult to attach tubes (e.g., that include wires) to the acoustic device. Because of the above-mentioned problems, user dissatisfaction has occurred with respect to previous approaches.

BRIEF DESCRIPTION OF THE DRAWINGS

For a more complete understanding of the disclosure, reference should be made to the following detailed description and accompanying drawings wherein.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The present approaches provide a diaphragm frame that also acts to separate and seal the front volume from the back volume of an acoustic assembly such as a receiver. In these regards, the present approaches seal the front volume and back volumes from each other in an easy and cost effective manner thereby providing acoustic devices that have excellent performance characteristics. The devices provided herein are easy to assemble and provide effective sealing capabilities. The approaches described herein also allow for the easy attachment of sound tubes and other devices.

In many of these embodiments, an acoustic assembly includes a top assembly and a bottom assembly. The top assembly is coupled to a bottom assembly to form an overall assembly. The overall assembly includes and houses a motor assembly, including a diaphragm assembly. The diaphragm assembly (that includes and supports a diaphragm) is positioned in the overall assembly so as to define a back volume and a front volume. The diaphragm assembly is configured to separate the front volume and the back volume and to seal the back volume from the front volume.

Figure 1:
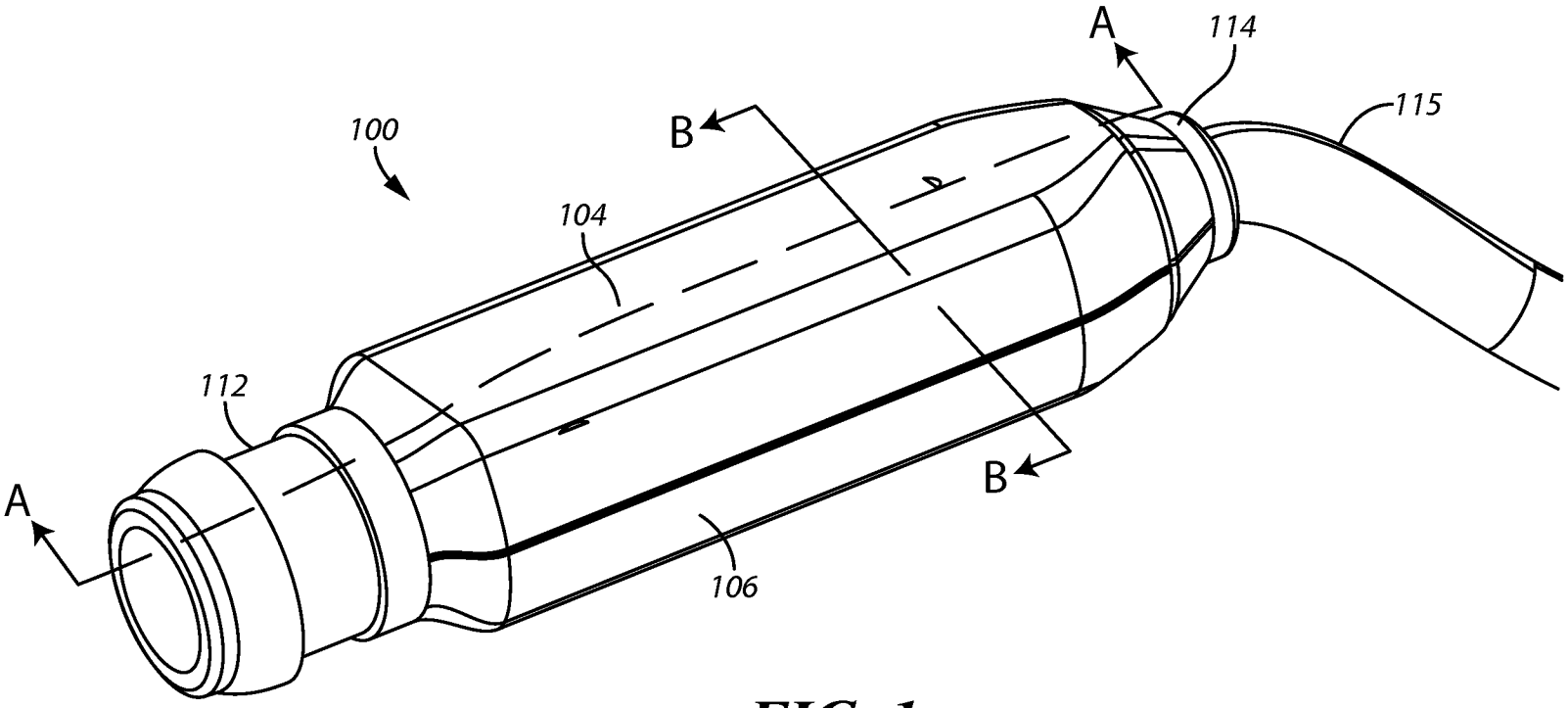
FIG. 1 comprises a perspective view of an acoustic assembly according to various embodiments of the present invention.
Figure 2:
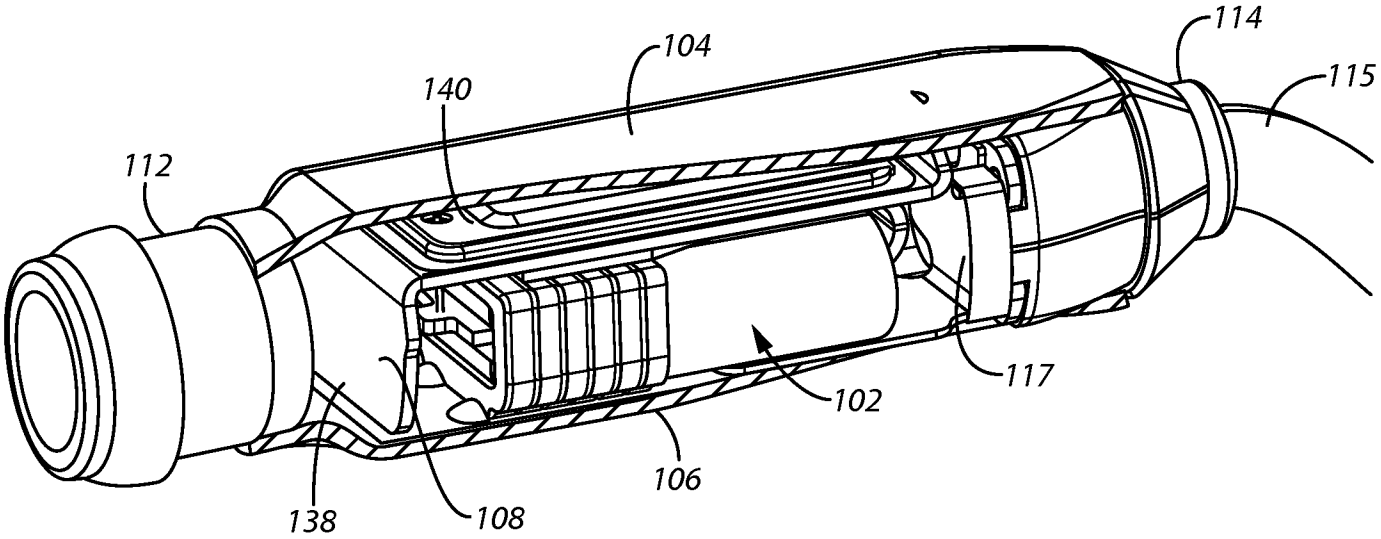
FIG. 2 comprises a perspective view of the acoustic assembly of FIG. 1 according to various embodiments of the present invention.
Figure 3:
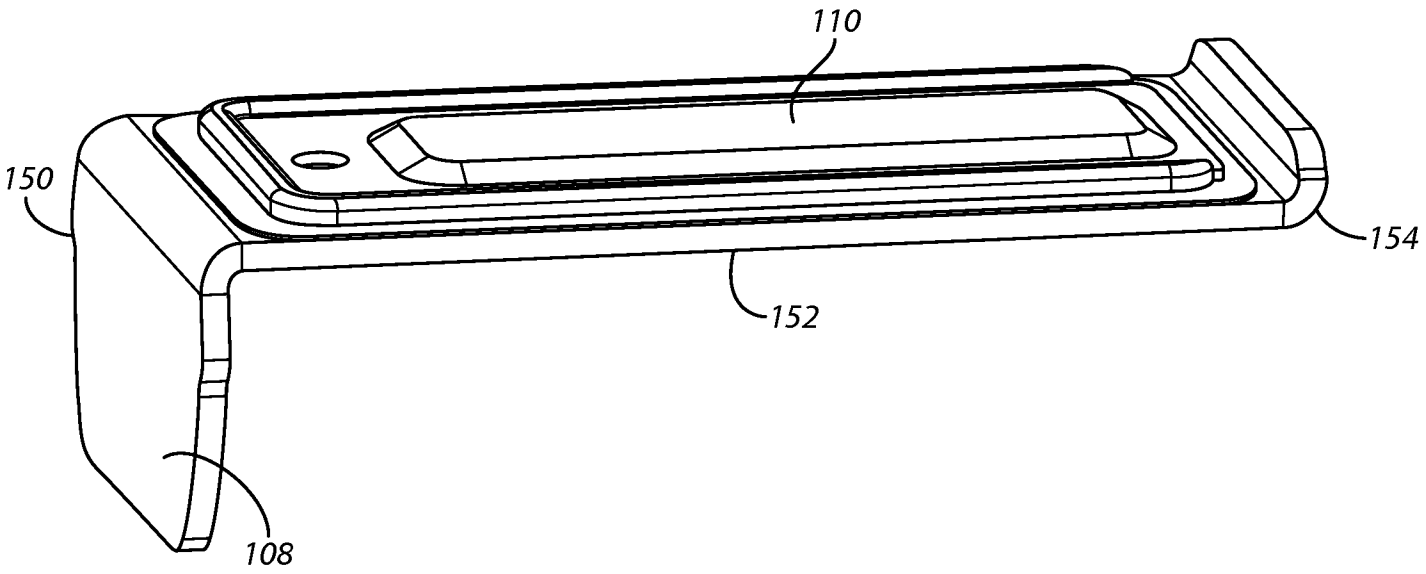
FIG. 3 comprises a perspective view of one example of a diaphragm frame according to various embodiments of the present invention.
Figure 4:
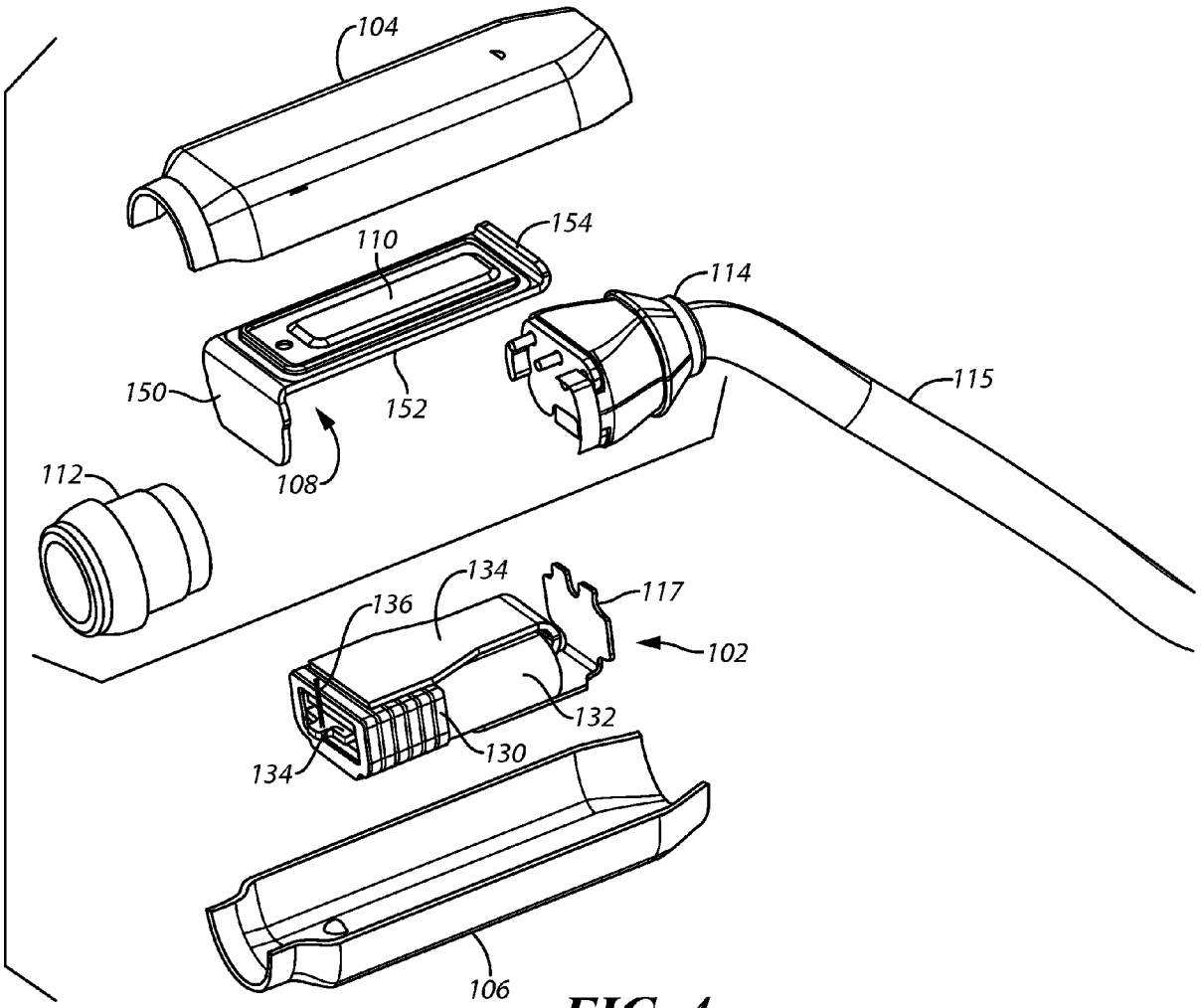
FIG. 4 comprises an exploded view of an acoustic assembly according to various embodiments of the present invention.
Figure 5:
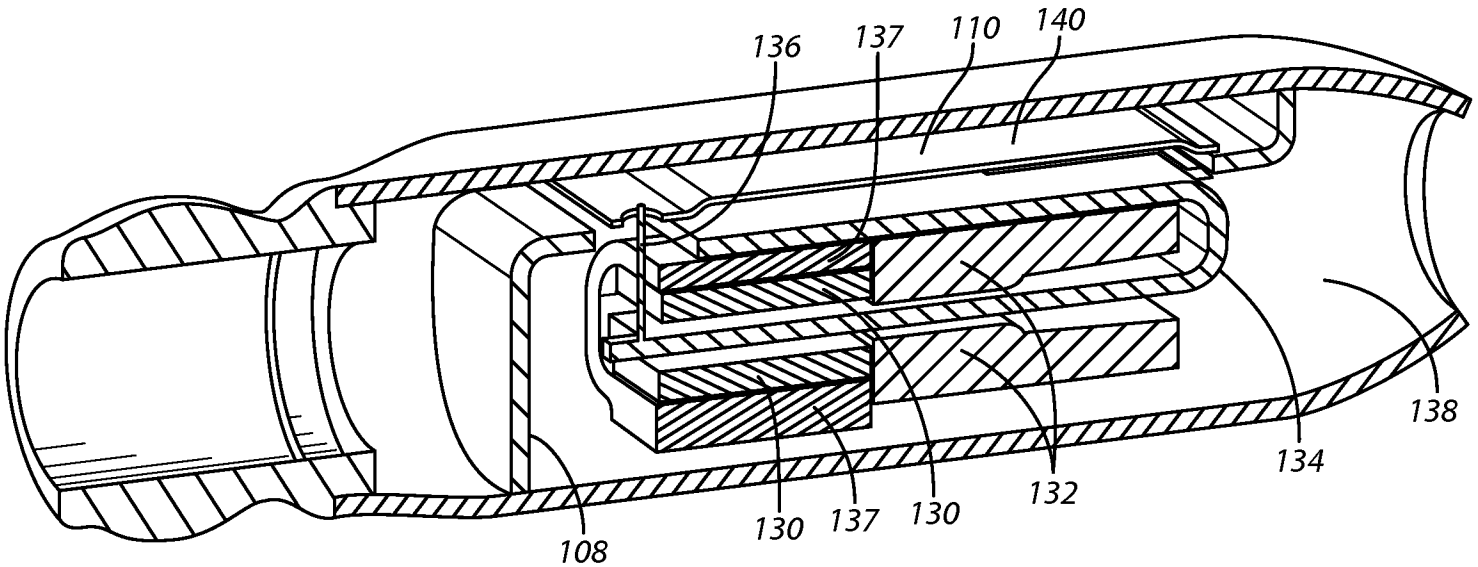
FIG. 5 comprises a cross-sectional view of the assembly of FIG. 1 taken along lines A-A according to various embodiments of the present invention.
Figure 6:
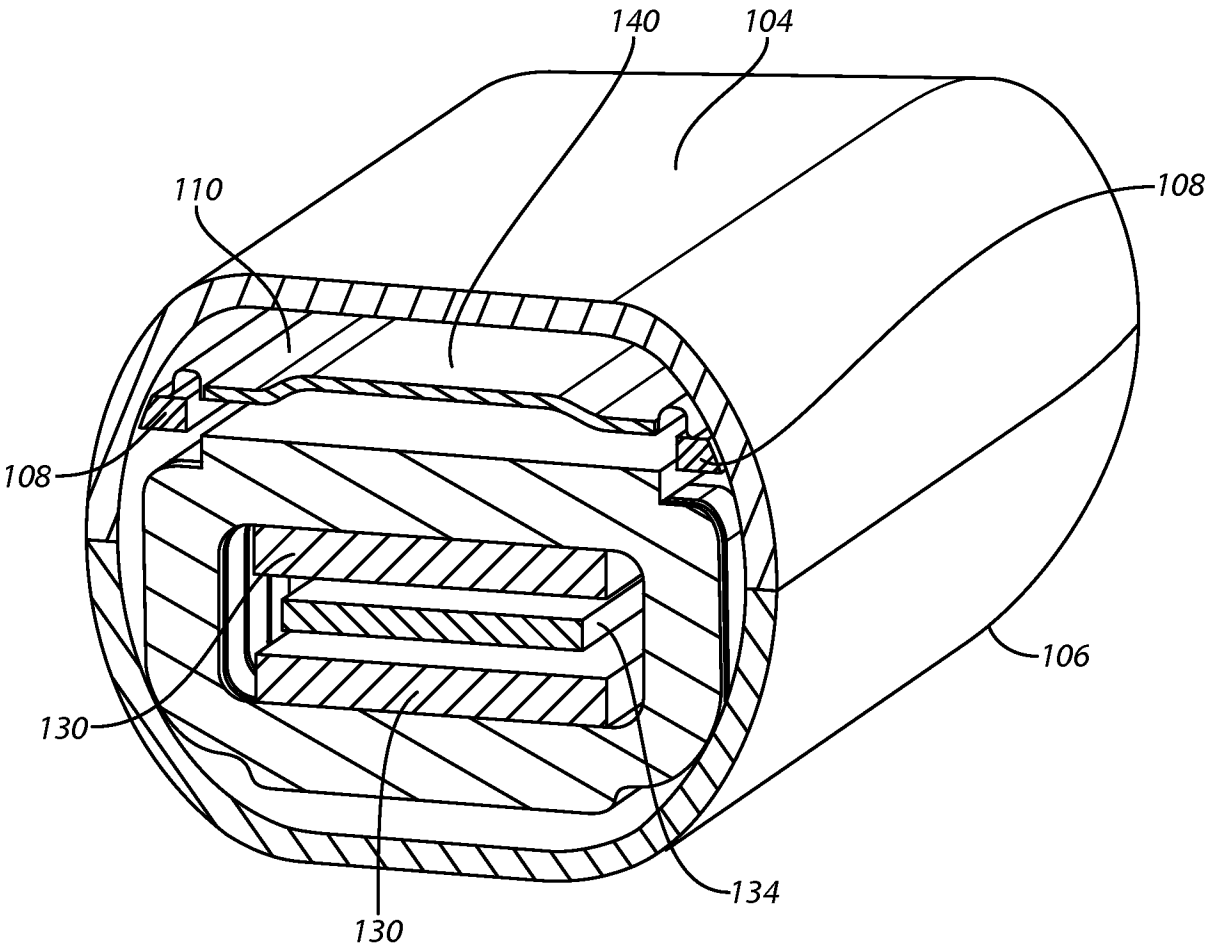
FIG. 6 comprises a cross-sectional view of the assembly of FIG. 1 taken along lines B-B according to various embodiments of the present invention.

Referring now to FIGS. 1-6, one example of an acoustic apparatus 100 (in this case a receiver) is described. The acoustic apparatus 100 includes a motor assembly 102, a top assembly 104, a bottom assembly 106, a diaphragm frame 108 (holding a diaphragm 110), a sound tube 112, a strain relief tube 114, and a cable assembly 115. The cable assembly 115 couples to a printed circuit board connector 117 and includes electrical wires that carry electrical signals. The PCB connector 117 couples to the motor assembly 102 (e.g., to coils in the assembly 102). The motor assembly 102 includes magnets 130, a coil 132, a reed (or armature) 134, a rod 136, and a stack 137.

In operation, an electrical signal received via the cable assembly 115 is applied to the coil 132 and creates a magnetic field within the motor assembly 102 which causes the reed 134 to move. Movement of the reed 134 causes movement of a diaphragm 110, which creates sound. Sound exists through the sound tube 112 to be presented to a listener. Together, the magnets 130, reed 134, and stack 137 form a magnetic circuit. The stack 137 may also serve to hold or support the magnets 130 or other components.

The diaphragm frame 108 forms a back volume 138 and a front volume 140. The diaphragm frame 132 seals the back volume 138 and the front volume 140 from each other. The diaphragm frame 108 generally has a first end portion 150 (forming an end, a middle portion 152 that holds the diaphragm 110, and a second portion 154. The first end portion 150 and secures the diaphragm frame to the bottom assembly 106 and the second end portion 154 secures the diaphragm frame 108 to the top assembly 104. In so doing, the diaphragm frame becomes a partition and seal between the front volume 140 and the back volume 138. The diaphragm frame 108 has two bends of approximately 90 degrees between the first end portion 150 and the middle portion 152, and between the middle portion 152 and the second end portion 154. In one example, the diaphragm frame 108 is constructed of metal. Other examples of materials can also be used to construct the diaphragm frame 108.

It will be appreciated that the shape and relative dimensions of the diaphragm frame 108 may vary. For example, the angles between the middle portion 152 and the end portions 150 and 154 may be changed from approximately 90 degrees to other values in order to suit the needs of the system. Additionally, the lengths of the end portions 150 and 154 may vary. Other changes to the shape and placement of the diaphragm frame 108 may be made so long as it separates and seals the back volume 138 from the front volume 140.

In the example shown in these figures and as viewed in the cross section, the first end portion 150 of the diaphragm frame 108 extends from the bottom assembly 106 upward. Then, it bends at approximately 90 degrees forming the middle portion 152. The middle portion 152 includes an opening over which the diaphragm 110 is disposed. The diaphragm assembly 108 then bends upward (again at an approximately 90 degree angle) and forms the second end portion 154. The second end portion 154 couples to the top assembly 104.

The coupling or connection of the first end portion 150 to the bottom assembly 106, and the second end portion 154 to the top assembly 104 is effective to form acoustic seals that seal the back volume 138 from the front volume. It will be appreciated that the acoustic seal is provided because the diaphragm frame 108 fits snugly against the top assembly 104 and the bottom assembly 106, and extends across the apparatus 100. In this regards, the diaphragm frame 108 may be attached to the top assembly 104 and the bottom assembly 106 by an adhesive or some other suitable fastening arrangement. In some instances, it may be possible to position the diaphragm frame 108 so as to provide a seal without the use of adhesive by simply dimension the part correctly so that a snug and tight fit is provided.

The top assembly 104 and the bottom assembly 106 may be constructed of, for example, metal. Other examples of materials may also be used.

The sound tube 112 is constructed of metal. The function of the adaptor tube 112 is to present sound to a user. This part can also be constructed of other materials, such as plastic, and can extend into the front volume to optimize acoustic performance.

The strain relief tube 114 is constructed of plastic. The function of the strain relief tube 114 is to secure the tube to the receiver.

Thus, the present approaches provide a diaphragm frame that also acts to separate and seal the front volume and the back volume of an acoustic assembly such as a receiver. The assembly so provided also allows the easy attachment of sound tubes and other devices while minimizing the overall size. Since the present approaches seal the front volume and back volumes from each other, acoustic devices that have excellent performance characteristics are provided.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. An acoustic apparatus comprising:

a top assembly that includes a first base that is coupled to at least one first side wall;

a bottom assembly that includes a second base that is coupled to at least one second side wall, the bottom assembly being coupled to the top assembly to form an overall assembly;

such that the first base and the second base are generally planar and generally parallel to each other;

a diaphragm assembly disposed in the overall assembly so as to separate the overall assembly into a front volume and a back volume;

wherein the diaphragm assembly includes a frame and the frame has a first end, a second end, and a middle portion disposed between the first end and the second end;

wherein the first end and the second end are not in the same plane as the middle portion;

wherein the first end is coupled to the second base of bottom assembly and the second end is coupled to the first base of top assembly.

2. The apparatus of claim 1 wherein an angle between the middle portion and the top portion is approximately 90 degrees.

3. The apparatus of claim 1 wherein the angle between the middle portion and the bottom portion is approximately 90 degrees.

4. The apparatus of claim 1 wherein an acoustic motor is disposed in the back volume.

5. The apparatus of claim 1 wherein the coupling of the first end of the diaphragm assembly to the bottom assembly and the coupling of the second end of the diaphragm assembly to the top assembly forms an acoustic seal between the front volume and the back volume.

6. The apparatus of claim 5 wherein the acoustic seal is formed at least partially with an adhesive.

7. The apparatus of claim 5 wherein the acoustic seal is formed by direct contact of the top portion to the diaphragm assembly and the bottom portion to the diaphragm assembly.

8. The apparatus of claim 1 wherein the frame is constructed of a metal.

* * * * *